United States Patent [19]

Gotoh

[11] 4,275,496

[45] Jun. 30, 1981

[54] SEMIAUTOMATIC ROTARY RAZOR

[76] Inventor: Bonpei Gotoh, 1-25-3, Hon Komagome, Bunkyo-ku, Tokyo, Japan

[21] Appl. No.: 48,364

[22] Filed: Jun. 14, 1979

[30] Foreign Application Priority Data

Jun. 27, 1978 [JP] Japan ..... 53-77773

[51] Int. Cl.[3] ..... B26B 19/32

[52] U.S. Cl. ..... 30/43.6; 74/30; 30/42

[58] Field of Search ..... 30/42, 43.5, 43.6; 74/30, 31, 130, 133

[56] References Cited

U.S. PATENT DOCUMENTS

| | | | |
|---|---|---|---|
| 1,384,053 | 7/1921 | Dupont | 74/130 X |
| 2,430,600 | 11/1947 | Booth | 74/31 |
| 2,619,720 | 12/1952 | Rasmussen | 30/43.6 |
| 3,141,240 | 7/1964 | Gwinn | 30/43.6 |

FOREIGN PATENT DOCUMENTS

| | | | |
|---|---|---|---|
| 1071671 | 3/1954 | France | 30/43.6 |
| 1108557 | 8/1955 | France | 30/43.6 |

*Primary Examiner*—Gary L. Smith

*Attorney, Agent, or Firm*—Pearne, Gordon, Sessions, McCoy & Granger

[57] ABSTRACT

A semiautomatic rotary razor which comprises a rectangular box-shaped framework, an annular cap detachably secured to one surface of the framework and having a reticulate outer blade, a rotary shaft extending across the framework with one end protruding out of the one surface of the framework, an inner blade assembly detachably mounted at the protruding end of the rotary shaft, a fly wheel and a driven gear mounted on the rotary shaft within the framework, a partition wall extending within the framework along the length thereof, a stub shaft extending within the framework adjacent and in parallel to the rotary shaft and slidably received in the framework and partition wall, a driven gear and a transmission gear mounted on the stub shaft and a slidable rack bar having rack teeth thereon for engaging the driven gear on the stub shaft.

7 Claims, 3 Drawing Figures

SEMIAUTOMATIC ROTARY RAZOR

BACKGROUND OF THE INVENTION

This invention relates to a semiautomatic rotary razor which eliminates the need of any separate power source which has been required in any conventional electrically driven razor and which can effectively perform shaving in the same manner as done by the prior art electrically driven razor.

There have been proposed and practically employed a great variety of electrically driven razors and most of the commercially available electrically driven razors are of the type which comprises a hollow cylindrical main body or grip member closed at the opposite ends and having a switch adjacent to one end thereof, an annular cap detachably secured at one end to the one end of the main body and having an outwardly convexed reticulate outer blade secured to and extending across the other end of the cap, a small type motor mounted within the main body and having the rotary shaft with one end of the shaft protruding out of the one end of the main body and an inner blade assembly mounted at the protruding end of the rotary shaft closely adjacent to the concaved inner surface of the reticulate outer blade. In use, a cell is placed within the main body to be electrically connected to the motor or the motor is electrically connected to an external power source by means of an electrical cord whereby when the switch is turned on the motor and accordingly, the inner blade assembly on the rotary shaft of the motor is rotated to o perform having in cooperation with the outer blade.

However, the prior art electrically driven razor using a cell as the power source has the disadvantage that the razor can not be operated when the cell has exhausted. The prior art electrically driven razor using an electrical cord has the disadvantages that the operation of the razor is subjected to limitation with respect to the availability of an external power source, that the cord interferes with shaving operation and that the motor moistens easily and is liable to get damaged.

Therefore, one object of the present invention is to provide a semiautomatic rotary razor which can eliminate the disadvantages in inherent in the prior art electrically driven razors referred to hereinabove.

Another object of the present invention is to provide a semiautomatic rotary razor which eliminates the use of a cell or any other external power source whereby the razor can be operated in any desired location at a desired time and which is relatively free of trouble which may be caused by moisture.

The above and other objects and attendant advantages of the present invention will be more readily apparent to those skilled in the art from a reading of the following detailed description in conjunction with the accompanying drawing which shows one preferred embodiment of the invention for illustration purpose only, but not for limiting the scope of the same in any way.

PREFERRED EMBODIMENT OF THE INVENTION

Figure 1:
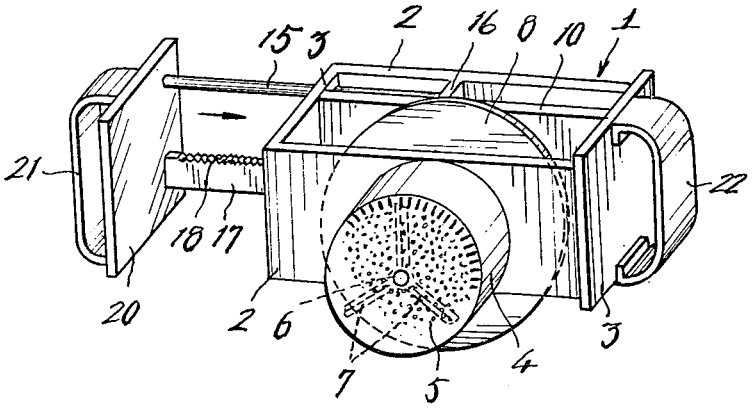
FIG. 1 is a perspective view of one preferred embodiment of semiautomatic rotary razor constructed in accordance with the present invention with the casing of the razor removed therefrom.

The present invention will be now described referring to the accompanying drawing which shows on preferred embodiment of semiautomatic rotary razor of the present invention for illustration purpose only.

The semiautomatic rotary razor generally comprises a rectangular box-shaped framework which is generally shown by reference numeral 1 and formed of light metal or synthetic resin. The framework 1 includes a pair of opposite and spaced side walls 2 and a pair of opposite and spaced end walls 3 which are connected at the opposite ends to the adjacent ends of the side walls 2. An annular cap 4 is detachably secured to the outer surface of one of the side walls 2 (the front side wall) and has an outwardly convexed reticulate outer blade 5 secured to and extending across the outer or front end of the cap. For the purpose, for example, the inner or rear end of the inner periphery of the cap 4 may be threaded to be received on the outer threaded surface of a conical boss (not shown) integrally formed with the outer surface of the front side wall 2.

A rotary shaft 6 extends through and is rotatably supported in the side walls 2 in the center of the side walls with the leading end of the shaft terminating short of the concaved inner surface of the convexed reticulate outer blade 5 and an inner blade assembly including a plurality of equally spaced inner blades 7 (three inner blades in the illustrated embodiment) is detachably secured to the outer end of the rotary shaft 6 within the cap 4 and positioned closely adjacent to the inner concaved surface of the reticulate outer blade 5 to perform shaving operation in cooperation with the latter. A fly wheel 8 is mounted on the rotary shaft 6 within the framework 1 and in the form of a steel or lead disc and also mounted on the rotary shaft 6 within the framework 1 rearwardly of the fly wheel 8 is a first driven gear 9.

A partition wall 10 extends between and is secured at the opposite ends to the end walls 3 of the framework 1 in parallel and spaced from the side walls 2 of the framework the shaft 6 also extends through a hole (not shown) in the partition wall 10. The partition wall 10 is formed with a horizontally elongated slot 11 in a position offset from the rotary shaft 6 and a stub shaft 12 is slidingly received at the opposite ends in the slot 11 in the partition walls 10 and a similar slot (not shown) in the rear side wall 2 for the purpose to be described hereinafter. A second driven gear 13 is mounted on the stub shaft 12 in the leading end portion thereof in front of the partition wall 10 for common rotation with the stub shaft and a transmission gear 14 is also mounted on the stub shaft 12 forwardly of the first driven gear 13.

Figure 2:
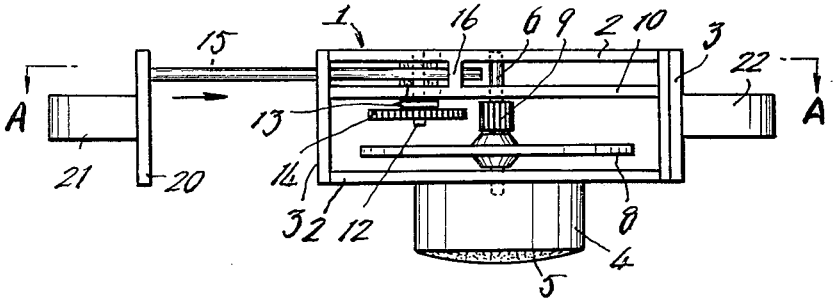
FIG. 2 is a plan view of FIG. 1.
Figure 3:
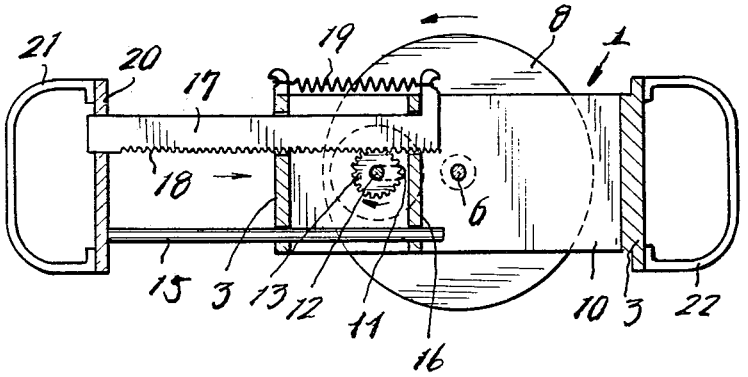
FIG. 3 is a ssectional view taken along substantially the line A—A of FIG. 2.

A slidable guide rod 15 extends through a guide hole (not shown) in one or the left-hand end wall 3 (as seen in FIGS. 1 and 2) and in a guide hole (not shown) in a transverse guide plate 16 which extends between the rear side wall 2 and partition wall 10 in a position between the shafts 6 and 12 in parallel to the end walls 3. The guide rod 15 is spring-loaded so that the guide rod is normally urged to the extended position as shown in FIGS. 1 through 3 and adapted to be moved to the retracted position within the framework 1 under manual effort which acts against the spring load applied to the guide rod as will be described hereinafter.

A spring-loaded slidable rack bar 17 having rack teeth 18 on the upper surface is positioned below the guide bar 15 and extends through another guide hole (not shown) in the left-hand end wall 3 as seen in FIGS. 1 and 2 and another aligned hole (not shown) in the guide plate 16 and is slidable between the extended position as shown in FIGS. 1 and 2 under the force of a spring which will be described hereinafter and the retracted position under manual effort which acts against the spring load applied thereto. A spring 19 extends between and is anchored at the opposite ends to the inner end of the rack bar 17 and the left-hand end wall 3 so as to normally urge the guide bar and rack bar to the extended position. The rack teeth 18 on the rack bar 17 is engaged with the driven gear 13 on the stub shaft 12. A manual operation plate 20 is attached to the outer ends of the guide rod 15 and rack bar 17 so that the guide rod 15 and rack bar 17 can slidably move together. Reference numerals 21 and 22 denote finger pieces, respectively.

In operation, the user places the thumb on his one hand into the space defined between the finger piece 22 and the adjacent end wall 3 and one or more of the remaining fingers of the same hand into the space defined between the finger piece 21 and the adjacent end wall 3. The user then first pushes the operation plate 20 against the force of the spring 19 so as to retract the guide rod 15 and rack bar 17 into the framework 1 whereby the rack teeth 18 on the rack bar 17 rotate the second driven gear 13 on the stub shaft 12. The retraction of the rack bar 17 moves the stub shaft 12 rightwards (as seen in FIGS. 1 through 3) along the slot 11 in the partition wall 10 and the corresponding slot (not shown) in the rear side wall 2 so that the transmission gear 14 engages as a geared clutch the first driven gear 9 on the rotary shaft 6 to rotate the first driven gear 9 which in turn rotates the rotary shaft 6 as well as the fly wheel 8 and inner blades 7 on the shaft. Thereafter, the user releases his manual effort from the rotational plate 20 so that the guide bar 15 and rack bar 17 are allowed to return to their initial or extended position under the force of the spring 19 whereby the transmission gear 14 disengages from the first driven gear 9.

Each time the manual effort application and release cycle is performed, rotary energy is incrementally accumulated on the rotary shaft 6 by the fly wheel 8. After an amount of rotation energy sufficient to perform one shaving operation has been accumulated on the rotary shaft 6 by repeating the manual effort application and release cycle, the user finally ceases to apply manual effort and thereafter, the accumulated rotational energy positively rotates the rotary shaft 6 for a time duration sufficient to perform one shaving operation whereby the inner blades 7 on the rotating shaft 6 perform shaving operation in cooperation with the outer blade 5 on the cap 4 in the same manner as done by a conventional electrically driven razor.

As clear from the foregoing description of one preferred embodiment of the present invention, the semiautomatic rotary razor of the invention does not require any separate power source such as a cell or any other external power source as required in any prior art electrically driven razor. Furthermore, the razor of the invention is free of trouble due to moisture which is one of the causes of trouble in the conventional electrically driven razors. In addition, the razor of the invention is simple in construction, less expensive and durable.

While only one embodiment of the invention has been shown and described in detail, it will be understood that the same is for illustration purpose only and not to be taken as a definition of the invention, reference being had for this purpose to the appended claims.

What is claimed is:

1. A semiautomatic rotary razor comprising a rectangular box-shaped framework including a pair of opposite and spaced side walls and a pair of opposite and spaced end walls, a transverse rotary shaft extending through said side walls with one end protruding out of the outer surface of one of said (the) side walls, an annular cap detachably secured at one end to said outer surface of said one of said walls and having a convexed reticulate outer blade secured to and extending across the other end of said cap, an inner blade assembly detachably secured to said rotary shaft closely adjacent to the concaved inner surface of said reticulate outer blade, a fly wheel and a first driven gear mounted on said rotary shaft inwardly of said inner blade assembly, a longitudinal partition wall extending between said end walls in parallel to said side walls, a stub shaft loosely mounted in said partition wall and the other of said side walls in a position offset from said rotary shaft, a transmission gear mounted on said stub shaft for engagement with said first driven gear, a second driven gear mounted on said stub shaft inwardly of said transmission gear, a spring-loaded slidable guide bar received in one of said end walls, a spring-loaded slidable rack bar received in said one end wall and having rack teeth thereon in engagement with said second driven gear on the stub shaft, an operation plate attached to the outer ends of said guide and rack bars, and a pair of finger pieces attached to the outer surface of said operation plate and the outer surface of the other end wall, respectively.

2. The semiautomatic rotary razor as set forth in claim, wherein said spring-loaded guide and rack bars include a spring extending between and anchored at the opposite ends to said one end wall and the inner end of said rack bar for normally urging said guide and rack bars outwardly of said framework and adapted to be overcome by manual effort.

3. The semiautomatic rotary razor as set forth in claim 1, in which said loose mounting of said stub shaft includes aligned horizontally elongated slots in said partition wall and the other of said side walls are in which the opposite ends of said stub shaft are slidably received.

4. The semiautomatic rotary razor as set forth in claim 1, in which a transverse guide plate extends between said partition wall and said other wide wall in a position between said one end wall and said rotary shaft, and said one end wall and said guide plate are provided with aligned holes for slidably receiving said guide and rack bars, respectively.

5. The semiautomatic rotary razor as set forth in claim 1, wherein said loose mounting of said stub shaft establishes a geared clutch connection between said rack bar and said inner blade assembly.

6. The semiautomatic rotary razor as set forth in claim 5, wherein said geared clutch connection includes the engaging and disengaging of said transmission gear and said first driven gear.

7. The semiautomatic rotary razor as forth in claim 5, wherein said geared clutch connection includes said partition wall and said other of said side walls being provided with aligned horizontally elongated slots in which said stub shaft is slidably received.

* * * * *

UNITED STATES PATENT AND TRADEMARK OFFICE

CERTIFICATE OF CORRECTION

PATENT NO. : 4,275,496

DATED : June 30, 1981

INVENTOR(S) : Bonpei Gotoh

It is certified that error appears in the above-identified patent and that said Letters Patent are hereby corrected as shown below:

Column 1, line 32,after "to" delete --o--
Column 1, line 32, delete "having" and insert --shaving--.
Column 2, line 1, delete "ssectional" and insert --sectional--.
Column 2, line 7, delete "on" and insert --one--
Column 2, line 49, delete "slidingly" and insert --slidably--
Column 2, line 50, delete "walls" and insert --wall--.
Column 2, line 59, after "in" (first occurrence), insert --the--
Claim 1, line 8, after "said" (second occurrence), insert --side--
Claim 2, line 2, after "claim", insert --1--.

Signed and Sealed this

*First* Day of *December 1981*

[SEAL]

*Attest:*

GERALD J. MOSSINGHOFF

*Attesting Officer*

*Commissioner of Patents and Trademarks*